US006648458B2

(12) United States Patent
Dod et al.

(10) Patent No.: US 6,648,458 B2
(45) Date of Patent: Nov. 18, 2003

(54) PINCH SEAL PROVIDING FLUID INTERCONNECTS BETWEEN FLUID DELIVERY SYSTEM COMPONENTS

(75) Inventors: Eric S. Dod, Corvallis, OR (US); Ralph L. Stathem, Lebanon, OR (US); Gregory W. Blythe, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 8 days.

(21) Appl. No.: 10/127,885

(22) Filed: Apr. 23, 2002

(65) Prior Publication Data

US 2003/0197765 A1 Oct. 23, 2003

(51) Int. Cl.[7] ..... B41J 2/175; B41J 2/14

(52) U.S. Cl. ..... 347/85; 347/47

(58) Field of Search ..... 347/85, 58, 47, 347/50, 5, 14, 54, 19, 60, 40, 20; 346/140.1; 251/367, 368, 129.16; 137/55, 115.2

(56) References Cited

U.S. PATENT DOCUMENTS

| | | | | |
|---|---|---|---|---|
| 5,699,091 A | | 12/1997 | Bullock et al. | 347/19 |
| 5,721,576 A | | 2/1998 | Barinaga | 347/85 |
| 6,017,118 A | | 1/2000 | Gasvoda et al. | 347/86 |
| 6,039,441 A | | 3/2000 | Tomikawa et al. | 347/86 |
| 6,072,509 A | * | 6/2000 | Wen et al. | 346/140.1 |
| 6,078,340 A | * | 6/2000 | Jeanmaire et al. | 346/140.1 |
| 6,091,433 A | * | 7/2000 | Wen | 346/140.1 |
| 6,130,695 A | | 10/2000 | Childers et al. | 347/85 |
| 6,137,501 A | * | 10/2000 | Wen et al. | 346/140.1 |

* cited by examiner

*Primary Examiner*—Lamson Nguyen
*Assistant Examiner*—K. Feggins

(57) ABSTRACT

A marking fluid valve for a marking fluid delivery system of a media marking device. The marking fluid valve includes a resilient body having first and second opposite ends in fluid communication with one another, with the first end having a pair of opposed lips. The pair of opposed lips define a normally closed slit extending therebetween. Compressing the first end of the resilient body along axes of the lips deforms the resilient body from a closed position, in which the lips are in contact with one another to close the slit and prevent marking fluid from passing through the slit, to an open position, in which the lips are spread at least partially apart from one another to enable marking fluid to pass through the slit.

35 Claims, 12 Drawing Sheets

PINCH SEAL PROVIDING FLUID INTERCONNECTS BETWEEN FLUID DELIVERY SYSTEM COMPONENTS

TECHNICAL FIELD

This invention relates to printing devices. In particular, the present invention is a fluid delivery system that employs pinch seal fluid interconnects to fluidly interconnect separable fluid delivery system components.

BACKGROUND OF THE INVENTION

Throughout the business world, inkjet printing systems are extensively used for image reproduction. Inkjet printers frequently make use of an inkjet printhead mounted within a carriage that is moved back and forth across print media, such as paper. As the printhead is moved relative to the print media, a control system activates the printhead to deposit or eject ink droplets onto the print media to form images and text. Such systems may be used in a wide variety of applications, including computer printers, plotters, copiers and facsimile machines.

Ink is provided to the printhead by a supply of ink that is either integral with the printhead, as in the case of a disposable print cartridge, or by a supply of ink that is replaceable separate from the printhead. One type of previously used printing system makes use of an ink supply that is carried with the carriage. This ink supply has been formed integral with the printhead, whereupon the entire printhead and ink supply are replaced when ink is exhausted. Alternatively, the ink supply can be carried with the carriage and be separately replaceable from the printhead. As a further alternative, the ink supply can be mounted to the printing system such that the ink supply does not move with the carriage. For the case where the ink supply is not carried with the carriage, the ink supply can be in fluid communication with the printhead to replenish the printhead or the printhead can be intermittently connected with the ink supply by positioning the printhead proximate to a filling station to which the ink supply is connected whereupon the printhead is replenished with ink from the refilling station. Generally, when the ink supply is separately replaceable, the ink supply is replaced when exhausted. The printhead is then replaced at the end of printhead life. Regardless of where the ink supply is located within the printing system, it is critical that the ink supply provides a reliable supply of ink to the inkjet printhead.

No matter what the arrangement of the ink supply and printhead, it is crucial that the replaceable ink supply and printhead be capable of establishing a reliable fluid connection with the printing system or with one another. This fluid interconnection should be capable of repeated disconnects and reconnects as the ink supply and printhead are removed and installed. Moreover, the fluid interconnect should be robust enough to prevent leakage under normal operating and non-operating conditions and under various environmental conditions. In addition, the fluid interconnects should prevent drooling of fluid when the ink supply and printhead are separated from the printing system. The fluid interconnections between the ink supply, printing system and printhead should reliably provide these features throughout the useful life of these fluid delivery system components so as to preclude premature replacement of these components and the associated cost. Lastly, the fluid interconnect should be relatively easy and inexpensive to manufacture, and relatively simple to incorporate into these components used in ink delivery systems of thermal inkjet printing systems.

SUMMARY OF THE INVENTION

The present invention is a marking fluid valve for a marking fluid delivery system of a media marking device. The marking fluid valve comprises a resilient body having first and second opposite ends in fluid communication with one another. The first end of the resilient body includes a pair of opposed lips. The pair of opposed lips define a normally closed slit extending therebetween, wherein compressing the first end of the resilient body along the axis of the lips deforms the resilient body from a closed position, in which the lips are in contact with one another to close the slit and prevent marking fluid from passing through the slit, to an open position, in which the lips are spread at least partially apart from one another to enable marking fluid to pass through the slit.

The pinch seal interconnects function to provide reliable fluid interconnects between fluid delivery system components, such as fluid supply containers, printheads and manifold structures of a printing device. The pinch seal fluid interconnects prevent drooling of fluid, when fluid delivery system components are separated.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
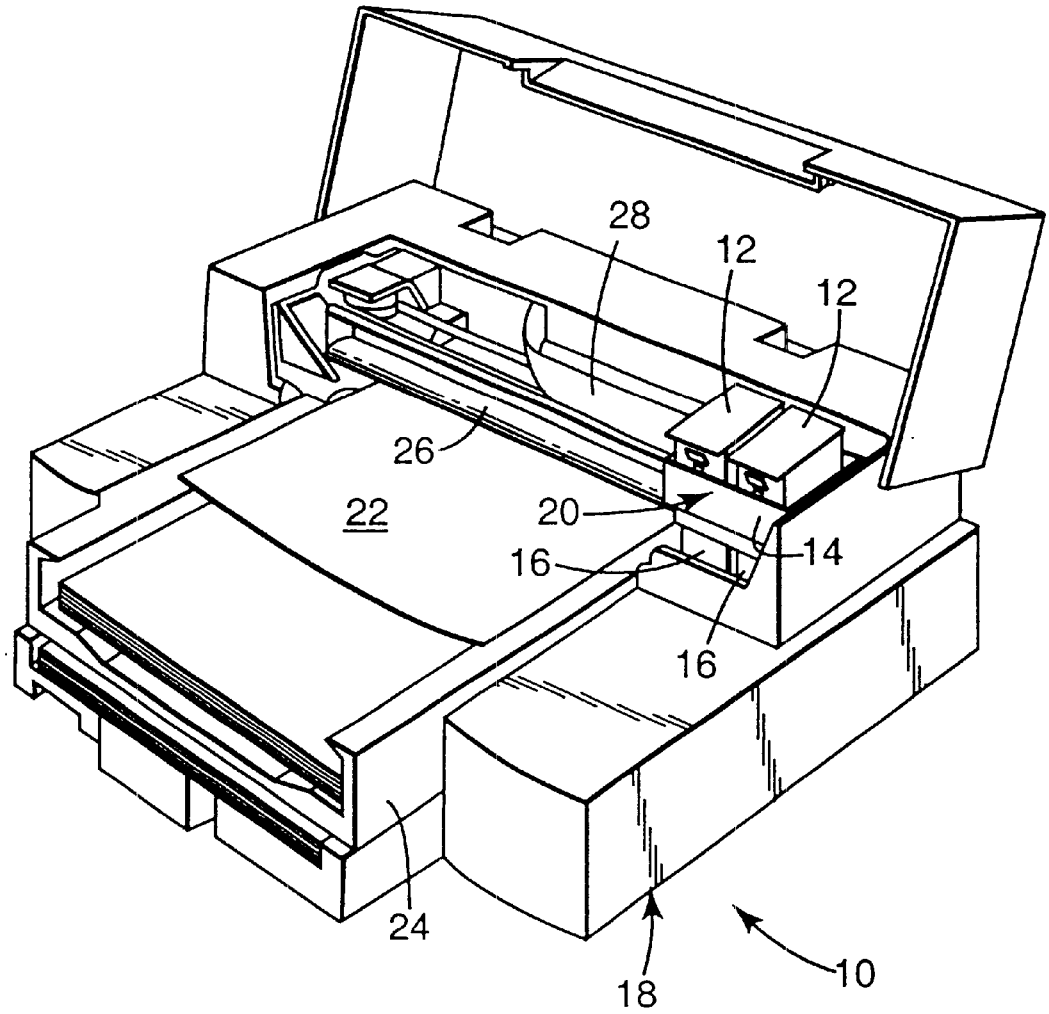
FIG. 1 is a perspective view of an exemplary printing system with a cover opened to show a plurality of replaceable ink containers, a receiving station, and a plurality of replaceable printhead cartridges incorporating pinch seal fluid interconnects in accordance with one embodiment of the present invention.

Exemplary pinch seal fluid interconnect 40 (see FIGS. 3*a* and 3*b*) in accordance with one embodiment of the present invention are useable to fluidically couple a replaceable fluid supply container 12, a manifold such as receiving station 14, and a printhead cartridge 16 of a thermal inkjet printing system 10 generally illustrated in FIGS. 1, 2, 3*a* and 3*b*.

In FIG. 1, the exemplary printing system 10, shown with its cover open, includes at least one replaceable fluid supply container 12 that is installed in a receiving station 14. In one preferred embodiment, the printing system 10 includes two replaceable fluid supply containers 12. With the replaceable fluid supply containers 12 properly installed into the receiving station 14, marking fluid, such as ink, is provided from the replaceable fluid supply containers 12 to at least one inkjet printhead cartridge 16 by way of the receiving station 14. In one preferred embodiment, one of the replaceable fluid supply containers 12 contains a single color fluid, such as black ink, while the other replaceable fluid supply container 12 contains multiple colors of fluid, such as cyan, magenta and yellow inks. Generally, the printing system 10 includes at least two replaceable printhead cartridges 16, such as one single color printhead cartridge 16 for printing from the black ink supply, and one multi-color printhead cartridge 16 for printing from the cyan, magenta and yellow ink supplies. In one embodiment, the printing system 10 includes four replaceable printhead cartridges 16, such that one printhead cartridge 16 is used for printing from each of the black, cyan, magenta and yellow ink supplies.

In operation, the inkjet printhead cartridges 16 are responsive to activation signals from a printer portion 18 to deposit fluid (i.e., ink) on print media 22. As the fluid is ejected from the printhead cartridges 16, the printhead cartridges 16 are replenished with fluid from the fluid containers 12. In one preferred embodiment, the replaceable fluid containers 12, receiving station 14, and the replaceable inkjet printhead cartridges 16 are each part of a scanning carriage 20 that is moved relative to the print media 22 to accomplish printing. The printer portion 18 includes a media tray 24 for receiving the print media 22. As the print media 22 is stepped through a print zone, the scanning carriage 20 moves the printhead cartridges 16 relative to the print media 22. The printer portion 18 selectively activates the printhead cartridges 16 to deposit fluid on print media 22 to thereby accomplish printing.

The scanning carriage 20 of FIG. 1 slides along a slide rod 26 to print along a width of the print media 22. A positioning means (not shown) is used for precisely positioning the scanning carriage 20. In addition, a paper advance mechanism (not shown) moves the print media 22 through the print zone as the scanning carriage 20 is moved along the slide rod 26. Electrical signals are provided to the scanning carriage 20 for selectively activating the printhead cartridges 16 by means of an electrical link, such as a ribbon cable 28.

Figure 2:
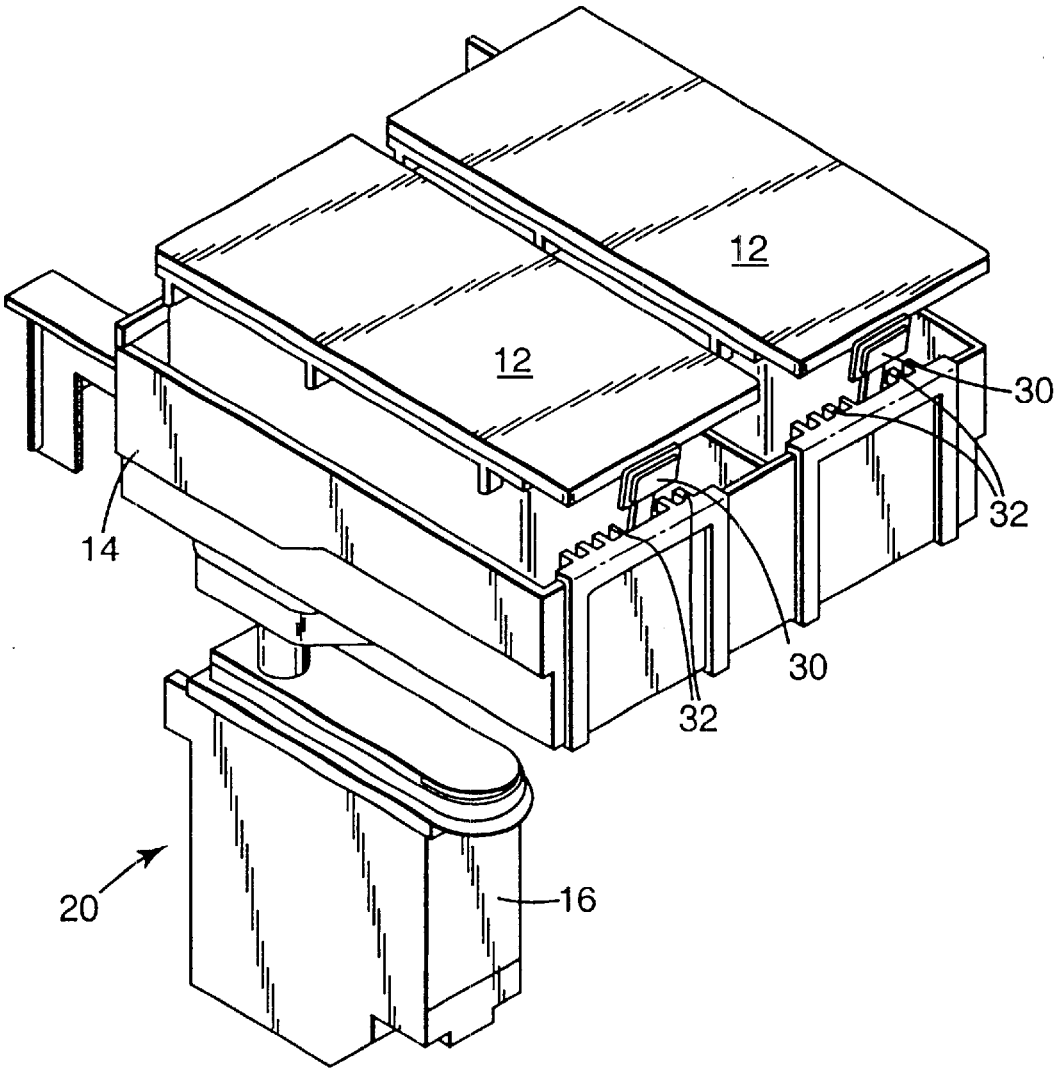
FIG. 2 is a perspective view a portion of a scanning carriage showing the replaceable ink containers positioned in the receiving station which includes a manifold that provides fluid communication between the replaceable ink containers and one or more printhead cartridges.

FIG. 2 is a perspective view of a portion of the scanning carriage 20 showing the pair of replaceable fluid containers 12 properly installed in the receiving station 14. For clarity, only a single inkjet printhead cartridge 16 is shown in fluid communication with the receiving station 14. As seen in FIG. 2, each of the replaceable fluid containers 12 includes a latch 30 for securing the replaceable fluid container 12 to the receiving station 14. In addition, the receiving station 14 includes a set of keys 32 that interact with corresponding keying features (not shown) on the replaceable fluid containers 12. The keying features on the replaceable fluid containers 12 interact with the keys 32 on the receiving station 14 to ensure that the replaceable fluid containers 12 are compatible with the receiving station 14.

Figure 3A:
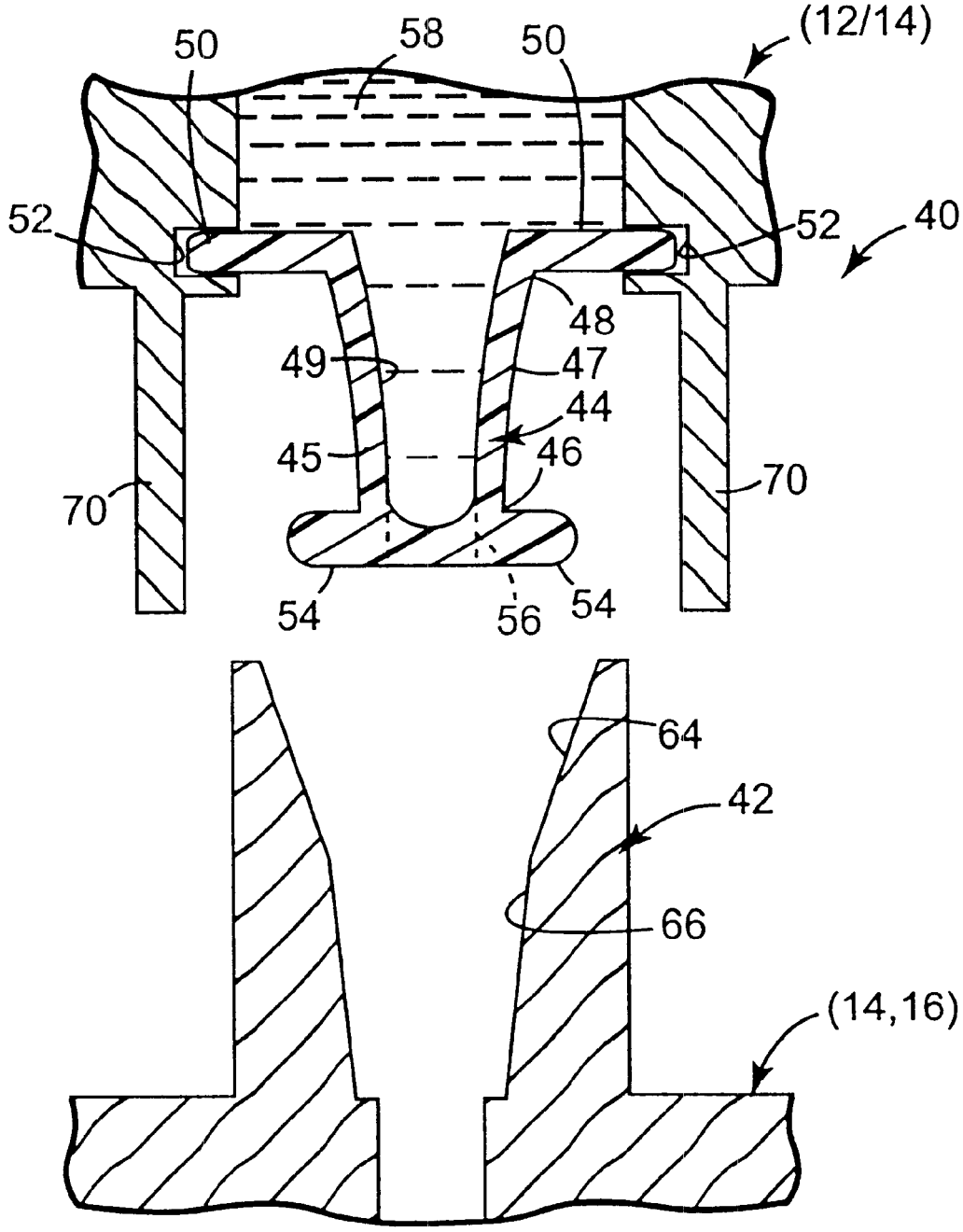
FIG. 3*a* is a side elevational view of an exemplary embodiment of the pinch valve positioned to be received by a tubular member that together define the pinch seal fluid interconnect of one embodiment of the present invention.
Figure 3B:
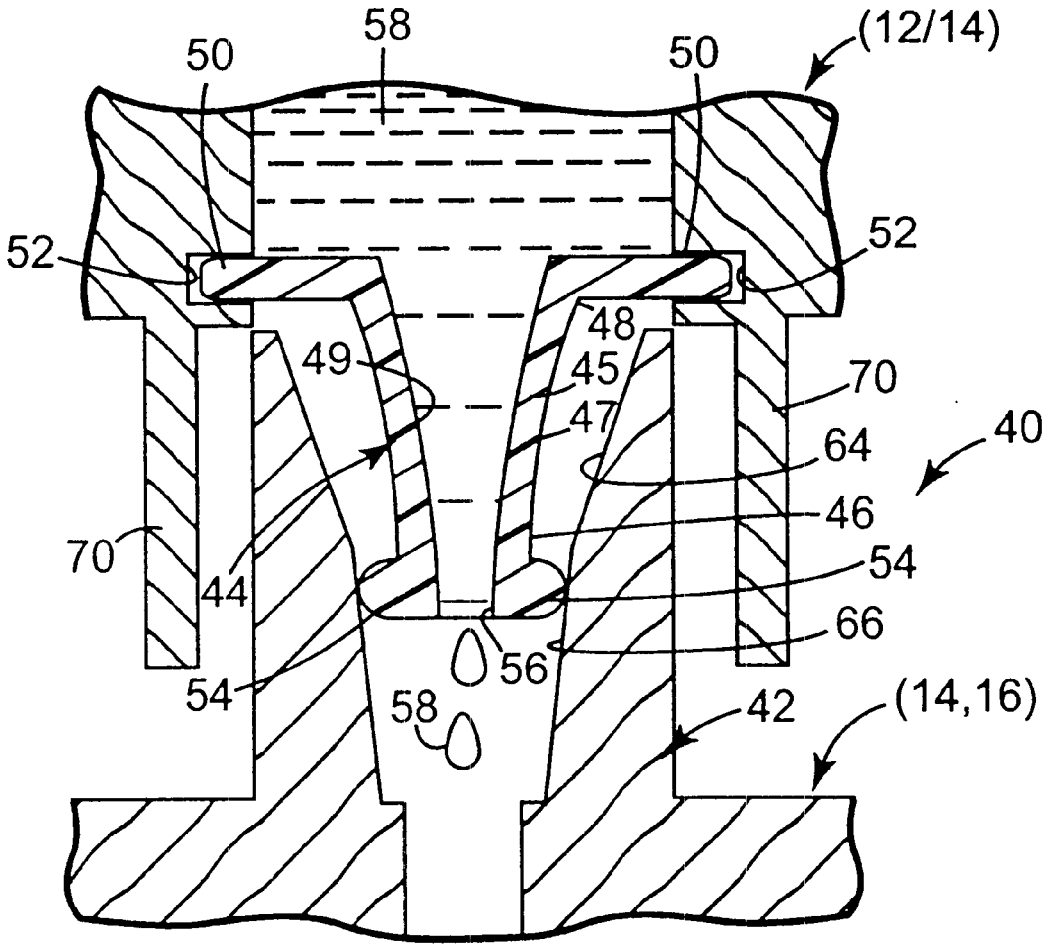
FIG. 3*b* is a side elevational view similar to FIG. 3*a* showing the exemplary embodiment of the pinch valve engaged with the tubular member and marking fluid flowing out of the pinch valve.
Figure 4A:
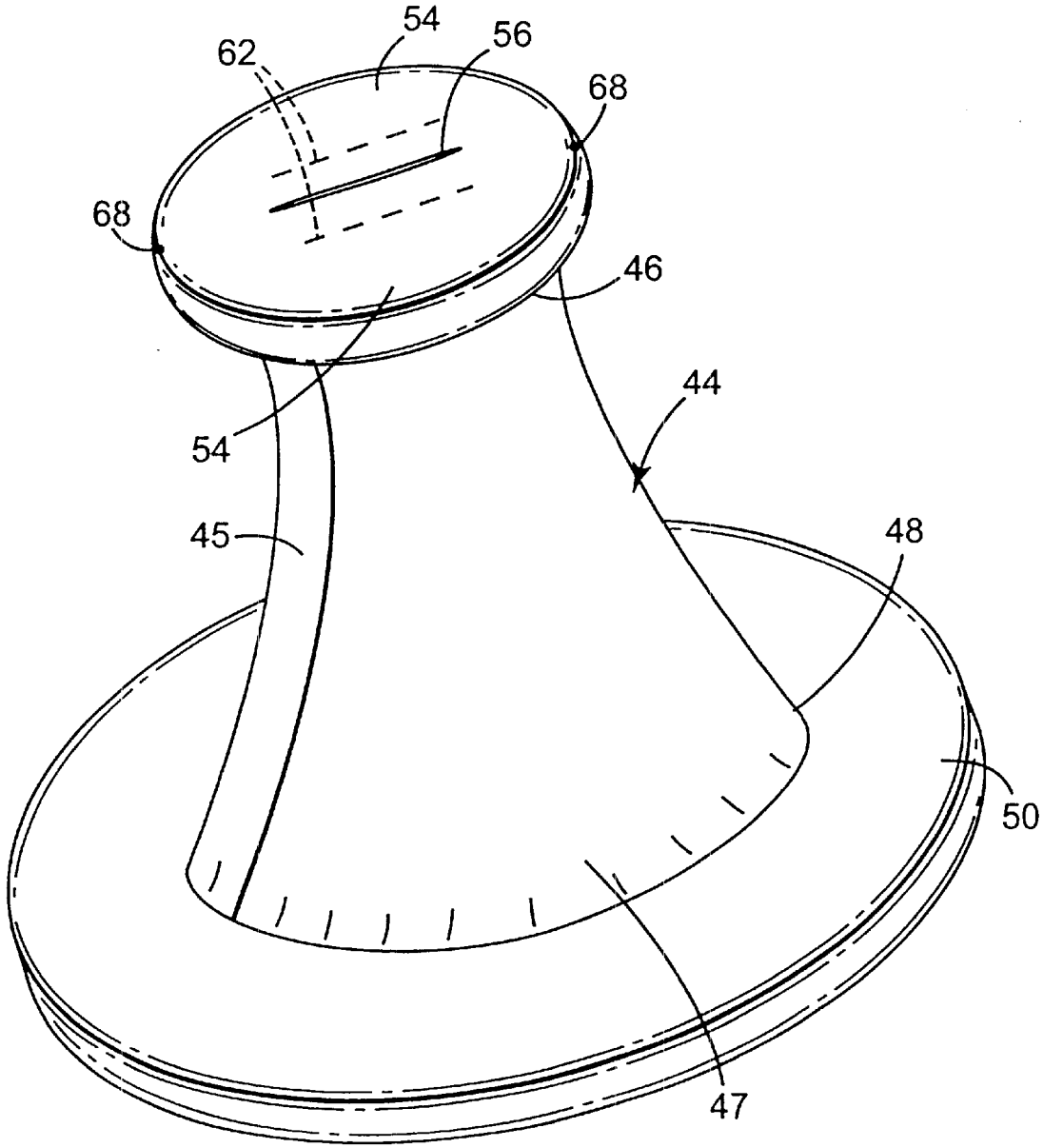
FIG. 4*a* is a perspective view of an exemplary embodiment pinch valve that forms a part of the pinch seal fluid interconnect in accordance with one embodiment of the present invention, with the pinch valve shown in a closed state.
Figure 4B:
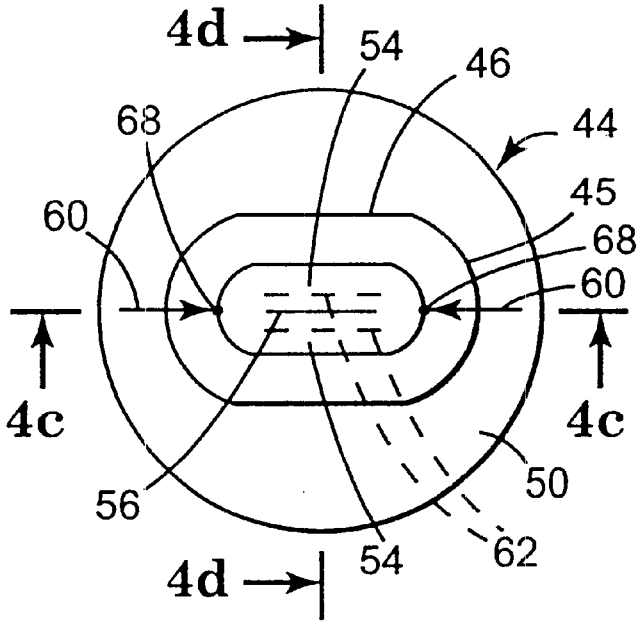
FIG. 4*b* is a top plan view of the exemplary embodiment pinch valve in a closed state of FIG. 3*a*.
Figure 4E:
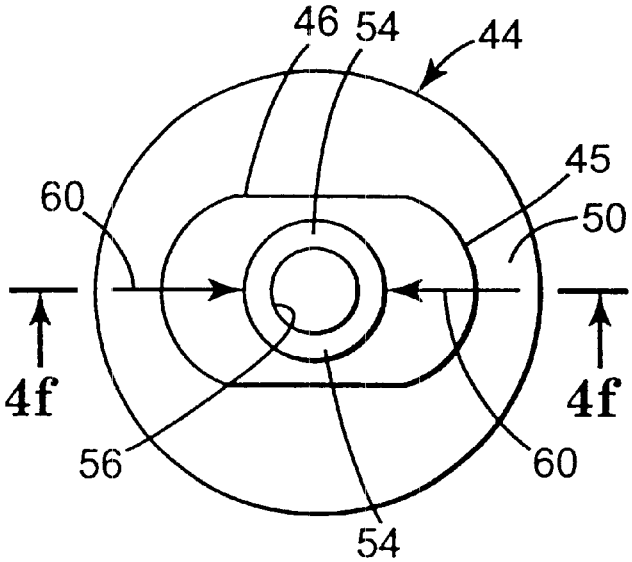
FIG. 4*e* is a top plan view of the exemplary embodiment pinch valve of FIGS. 4*a* through 4*d* but shown in an opened state.
Figure 4C:
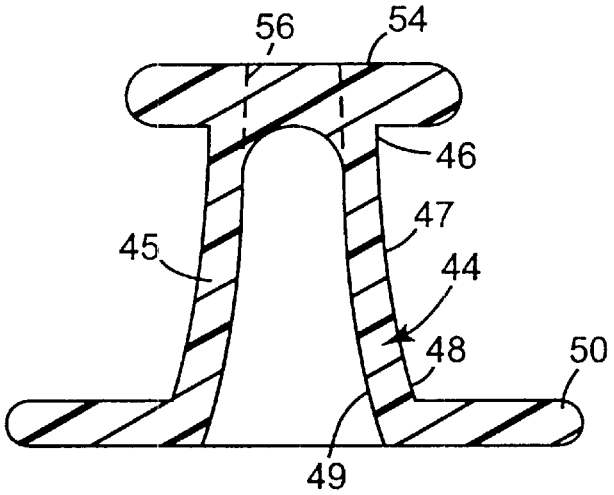
FIG. 4*c* is a sectional view taken along lines 4*c*—4*c* in FIG. 4*b*.
Figure 4D:
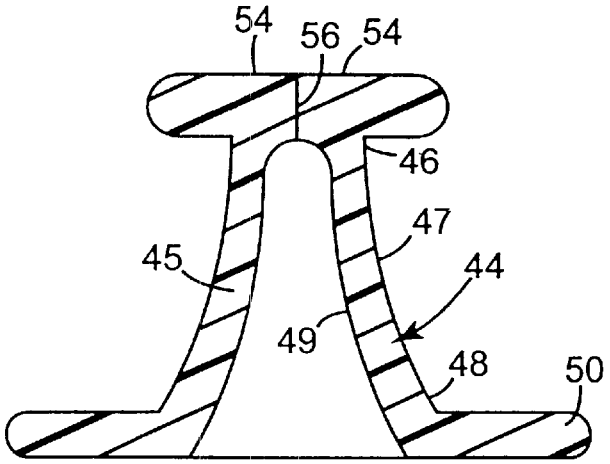
FIG. 4*d* is a sectional view taken along lines 4*d*—4*d* in FIG. 4*b*.
Figure 4F:
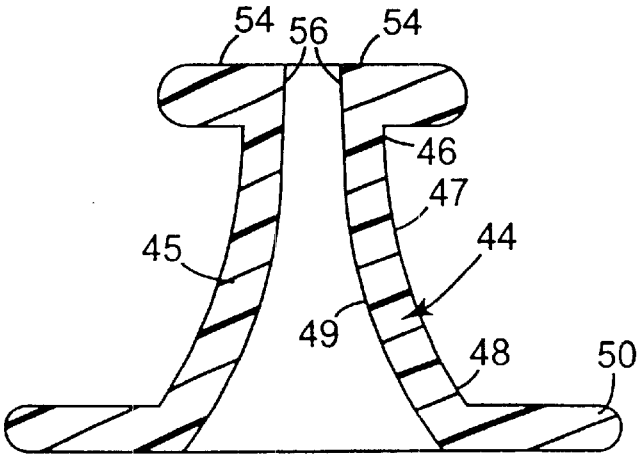
FIG. 4*f* is a sectional view taken along lines 4*f*—4*f* in FIG. 4*e*.

FIGS. 3*a* and 3*b* illustrate the exemplary pinch seal fluid interconnect 40 in disengaged (FIG. 3*a*) and engaged (FIG. 3*b*) states in accordance with one embodiment of the present invention. The pinch seal fluid interconnect 40 is defined by a rigid tubular member 42 adapted to releasably receive a pinch valve member 44. For the purposes of this discussion, the rigid tubular member 42 forms part of the receiving station (i.e., manifold) 14, while the pinch valve member 44 is mounted on the replaceable fluid supply container 12 to form a reliable fluid interconnect therebetween. However, it is to be understood that the rigid tubular member 42 could form part of the printhead cartridge 16, while the pinch valve member 44 is mounted on the receiving station 14 to form a reliable fluid interconnect between these two elements of the fluid delivery system of the printing system 10.

As seen best in FIGS. 4*a*–4*f*, the exemplary pinch valve member 44 of the pinch seal fluid interconnect 40 has a resilient body 45 having a first end 46, and an opposite second end 48 in fluid communication with the first end 46. The resilient body 45 also includes an exterior surface 47 and an opposite interior surface 49. As seen best in FIGS. 4*a*, 4*c*, 4*d* and 4*f*, the resilient body 45 is substantially cone shaped between the first and second ends 46 and 48. In particular, the second end 48 of the resilient body 45 has a greater circumferential dimension than the first end 46, with a smooth transition therebetween. In one preferred embodiment, the resilient body 45 is formed of an elastomer material compatible with ink. The second end 48 of the resilient body includes an integral mounting flange 50 by which the resilient body 45 of the pinch valve member 44 is retained on the replaceable fluid supply container 12 (see FIGS. 3*a* and 3*b*). To accomplish this, the fluid supply container 12 includes a clamping structure 52 which engages the mounting flange 50, and secures the resilient body 45 of the pinch valve member 44 to the fluid supply container 12. The resilient nature of the resilient body 45 together with the clamping force provided by the clamping structure 52 acts to form a fluid tight seal at the interface of the pinch valve member 44 and the fluid supply container 12.

The first end 46 of the resilient body 45 includes a pair of opposed lips 54. The lips 54 define a normally closed slit 56 (see FIGS. 4*a* and 4*b*). Applying a compressive force to the exterior surface 47 of the resilient body 45 at the lips 54 deforms the lips 54 from a closed state (see FIGS. 3*a* and 4*a*–4*d*), in which the lips 54 are in contact with one another to close the slit 56 and prevent marking fluid 58 from passing through the slit 56, to an opened state (see FIGS. 3*b*, 4*e* and 4*f*), in which the lips are spread apart from one another to allow marking fluid 58 to pass through the slit 56. In particular, the compressive force is a pair of oppositely directed compressive forces 60 (see FIG. 4*e*) applied to the lips 54 in a direction along (i.e., parallel to) axes 62 of the lips 54 to deform the lips 54 of the resilient body 45 from the closed state to the opened state of the slit 56. In other words, the pair of oppositely directed compressive forces 60 (see FIG. 4*e*) are applied to the exterior surface 47 at the lips 54 and at opposite ends of the slit 56 in a direction generally parallel to a longitudinal extent of the slit 56 to deform the lips 54 at the first end 46 of the resilient body 45 from the closed state to the opened state of the slit 56. Removal of the oppositely directed compressive forces 60 allows the lips 54 to return to their normal state in which the slit 56 is closed.

Figure 5:
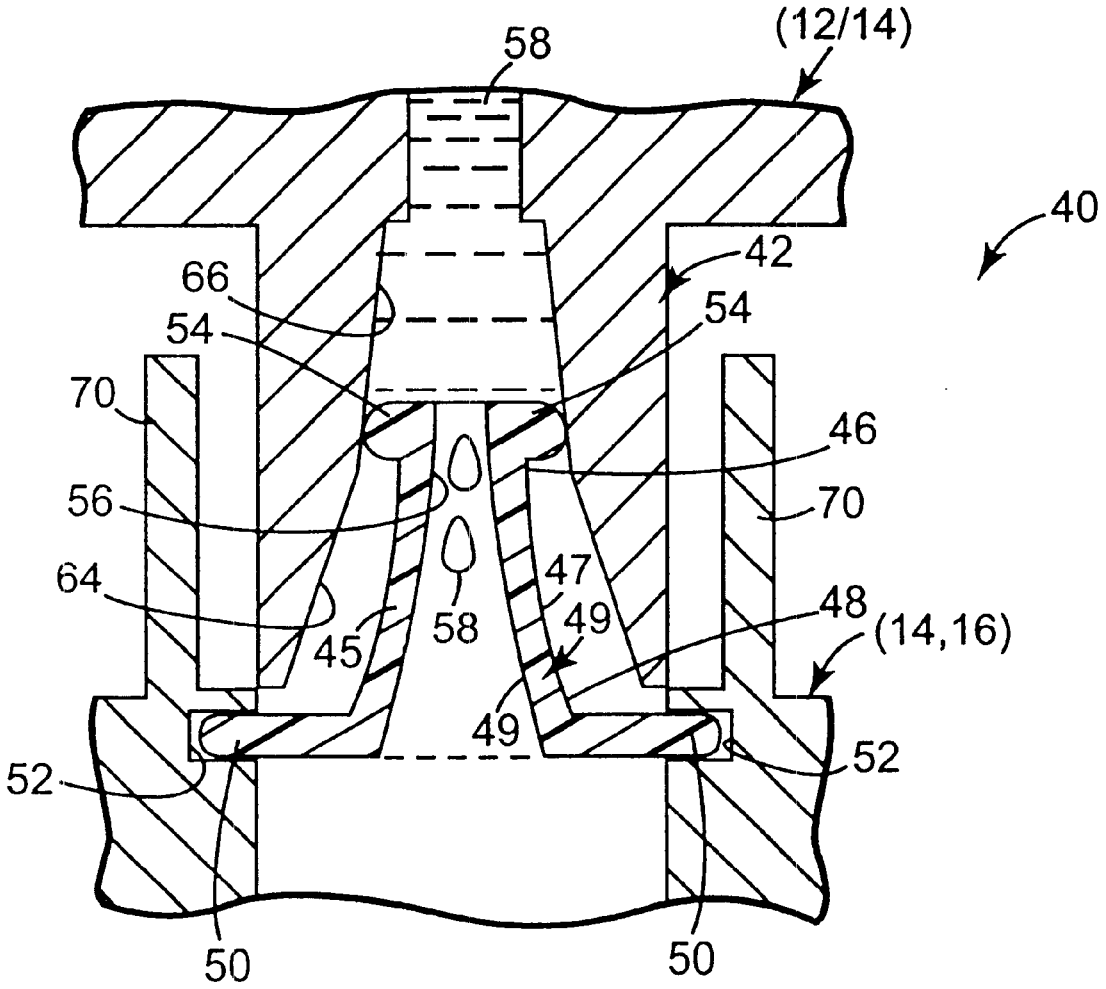
FIG. 5 is a side elevational view similar to FIG. 3*b* showing the exemplary embodiment pinch valve engaged with the tubular member and marking fluid flowing into the pinch valve.

In FIGS. 3*a* and 3*b*, the pinch valve member 44 forms a fluid outlet that allows marking fluid 58 to pass out of the fluid supply container 12 (or out of the receiving station 14) through the resilient body 45, from the second end 48 to the first end 46 thereof, and through the open slit 56 (in the opened state of the lips 54) and into the receiving station (i.e., manifold) 14 (or into the printhead cartridge 16). Alternatively, as illustrated in FIG. 5, the pinch valve member 44 could form a fluid outlet that allows marking fluid 58 to pass out of the fluid supply container 12 (or out of the receiving station 14), into the open slit 56 (in the opened state of the lips 54), through the resilient body 45, from the first end 46 to the second end 48 thereof, and into the receiving station (i.e., manifold) 14 (or into the printhead cartridge 16).

As seen best in FIGS. 3*a* and 3*b*, the rigid tubular member 42 is adapted to releasably receive the pinch valve member 44 upon engagement of the fluid supply container 12 (or the receiving station 14) with the receiving station 14 (or the printhead cartridge 16). The rigid tubular member 42 has interior wall portions that define a lead-in region 64 and an actuating region 66 of the tubular member 42. The actuating region 66 has a greater pitch than the lead-in portion 64. As can be best viewed by comparing FIGS. 3*a* and 3*b*, upon initial engagement of the container 12 with the receiving station 14, the lead-in region 64 of the tubular member 42 acts to guide the first end 46 of the resilient body 45 into the actuating region 66. Upon full engagement of the container 12 with the receiving station 14, the actuating region 66 applies the oppositely directed compressive forces 60 to the lips 54 in order to deform the lips 54 and move the slit 56 from the closed state to the opened state to allow the marking fluid 58 to pass therethrough. The actuating region 66 applies the compressive forces 60 to the lips 54 of the resilient body because the diameter of the actuating region 66 is less than a maximum linear dimension between opposed points 68 (see FIG. 4*b*) on the perimeter of the resilient body at lips 54. Because the diameter of the actuating region is less than the maximum linear dimension at the lips 54 of the resilient body 45, the lips 54 at the first end 46 are deformed when they enter into the actuating region 66.

Pinch seal fluid interconnects 40 establish reliable fluid connections between the fluid supply container 12 and the receiving station 14, and between the receiving station 14 and the printhead cartridge 16. However, it is to be understood that the pinch seal fluid interconnect 40 of the present invention can also form a reliable fluid connection between a fluid supply container 12 and a printhead cartridge 16. Moreover, it is to be understood that the pinch valve member 44 can act as a fluid outlet or a fluid inlet. In addition the pinch seal fluid interconnect 40 is capable of repeated disconnects and reconnects as the ink supply 12 and printhead 16 are removed and installed. Further, the resiliency of the pinch valve member 44 and the provision of the lead-in portion 64 of the tubular member 42 permits slight misalignment of the printer components to be connected while still insuring a reliable fluid interconnect. Since the pinch seal fluid interconnect 40 can tolerate some axial misalignment of the printer components to be connected, the printer components do not have to be manufactured to as high tolerances as prior printer components employing fluid interconnects that do not accommodate any misalignment of the printer components. Moreover, the pinch seal fluid interconnect 40 is robust enough to prevent leakage under normal operating and non-operating conditions and under various environmental conditions. In addition, the pinch valve member 44 prevents drooling of fluid when the ink supply 12 and printhead are separated from the printing system. To this end, the ink supply container 12 includes a guard 70 that prevents damage to the pinch valve member when the ink supply 12 has been removed from the printing system 10. The pinch seal fluid interconnect 40 reliably provides these above features throughout the useful life of the fluid delivery system components of the printing system 10 so as to preclude premature replacement of these components and the associated cost. Lastly, the pinch seal fluid interconnect 40 is relatively easy and inexpensive to manufacture, and relatively simple to incorporate into components used in ink delivery systems of thermal inkjet printing systems.

Figure 6A:
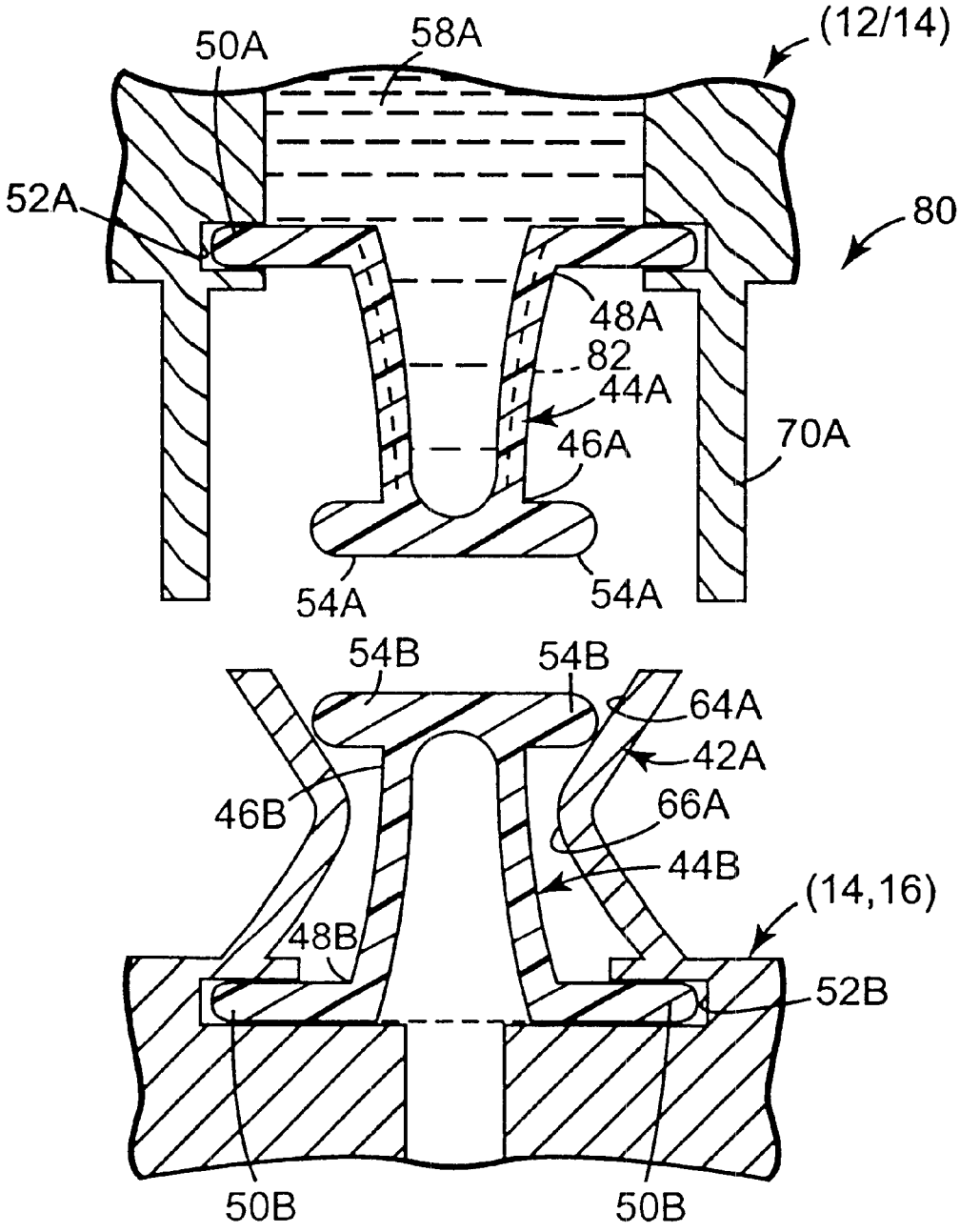
FIG. 6*a* is a side elevational view of an exemplary embodiment pinch seal fluid interconnect showing the elements of the fluid interconnect in a disengaged state in accordance with one further embodiment of the present invention.
Figure 6B:
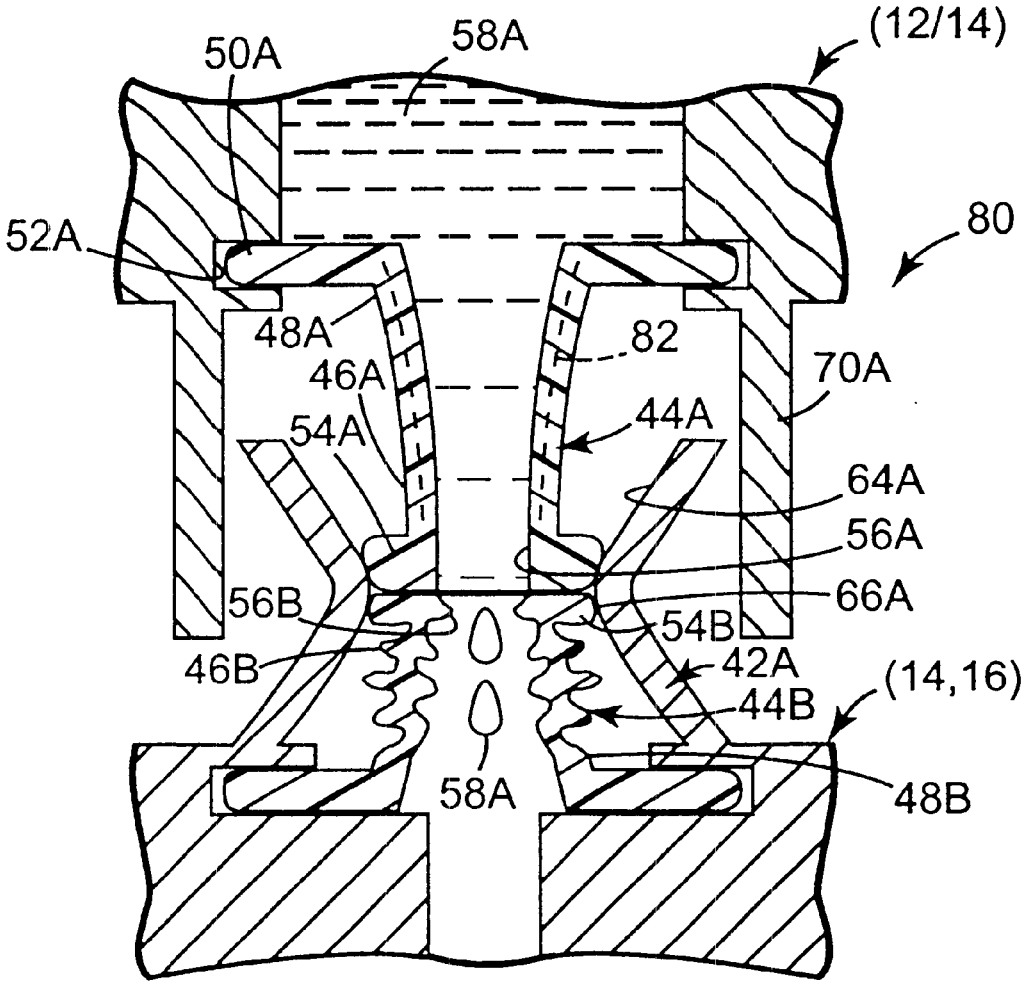
FIG. 6*b* is a side elevational view similar to FIG. 6*a* showing the elements of the fluid interconnect engaged with one another.

FIGS. 6*a* and 6*b* illustrate an alternative embodiment pinch seal fluid interconnect 80. Like parts are labeled with like numerals except for the addition of the subscript "A" unless otherwise noted. This alternative embodiment makes use of a pair of the pinch valve members 44A, 44B. One pinch valve member 44A is mounted to the fluid supply container 12 and the other pinch valve member 44B is mounted to the receiving station 14. The pinch valve members are identical except that the pinch valve member 44B is made of a softer elastomer material than the pinch valve member 44A. This alternative pinch seal fluid interconnect 80 includes an hour glass shaped rigid tubular member 42A. The tubular member 42A is mounted to the receiving station 14 such that the tubular member 42A surrounds the pinch valve member 44B. The tubular member 42A includes a lead-in region 64A and an actuating region 66A that function identical to the lead-in and actuating regions 64, 66 of the tubular member 42. The pinch valve member 44B is positioned in the tubular member 42A such that the first end 46B of the pinch valve member 44B is positioned within the lead-in region 64A of the tubular member 42A.

Upon initial engagement of the container 12 with the receiving station 14, the lead-in region 64A of the tubular member 42A acts to guide the first end 46A of the pinch valve member 44A into the actuating region 66A. Upon full engagement of the container 12 with the receiving station 14, the lips 54A at the first end 46A of the pinch valve member 44A bear against the lips 54B at the first end 46B of the pinch valve member 44B which causes the pinch valve member 44B to deform along its longitudinal extent (see FIG. 6*b*) since it is of a softer elastomer material than the pinch valve member 44A. This causes the lips 54A, 54B at the first ends 46A, 46B of both of the pinch valve members 44A, 44B to enter the actuating region 66A of the tubular member 42A which applies the oppositely directed compressive forces 60 to the exterior surfaces 47A, 47B of the pinch valve members 44A, 44B in order to deform the lips 54A, 54B and move the slits 56A, 56B from their closed states to the opened states to allow the marking fluid 58 to pass therethrough. The actuating region 66A applies the compressive forces 60 to the lips 54A, 54B because the diameter of the actuating region 66A is less than a maximum linear dimension of the lips 54A, 54B. As an alternative to forming the pinch valve member 44B of a softer elastomer material than the pinch valve member 44A, the pinch valve member could include an internal rigidifying tubular element 82, which would provide the necessary stiffness to allow the pinch valve member 44A to deform the pinch valve member 44B along its longitudinal extent. Removal of the ink container 12 from the receiving station allows the pinch valve member 44B to return to its original non-deformed state, with the lips 54A, 54B in a closed state.

It is to be understood that as an alternative, the pinch valve member 44B could be formed so as to be normally in the opened state. In this version, the lips 54B of the pinch valve member 44B would normally be positioned within the actuating region 66A of the tubular member 42A so that the actuating region 66A would hold the lips 54B of the pinch valve member 44B in the closed state. In this version, upon full engagement of the container 12 with the receiving station 14, the lips 54A at the first end 46A of the pinch valve member 44A would bear against the lips 54B at the first end 46B of the pinch valve member 44B which would cause the pinch valve member 44B to deform along its longitudinal extent since it is of a softer elastomer material than the pinch valve member 44A. This causes the lips 54A at the first end 46A of the pinch valve member 44A to enter the actuating region 66A of the tubular member 42A which deforms the lips 54A and moves the slit 56A from its closed state to its opened state, while the lips 54B of the pinch valve member 44B are moved below the actuating region 66A which allows the lips 54B of the pinch valve member 44B to return to their normal state wherein the slit 56B moves from the closed state to the normally opened state to allow the marking fluid 58 to pass therethrough.

Figure 7A:
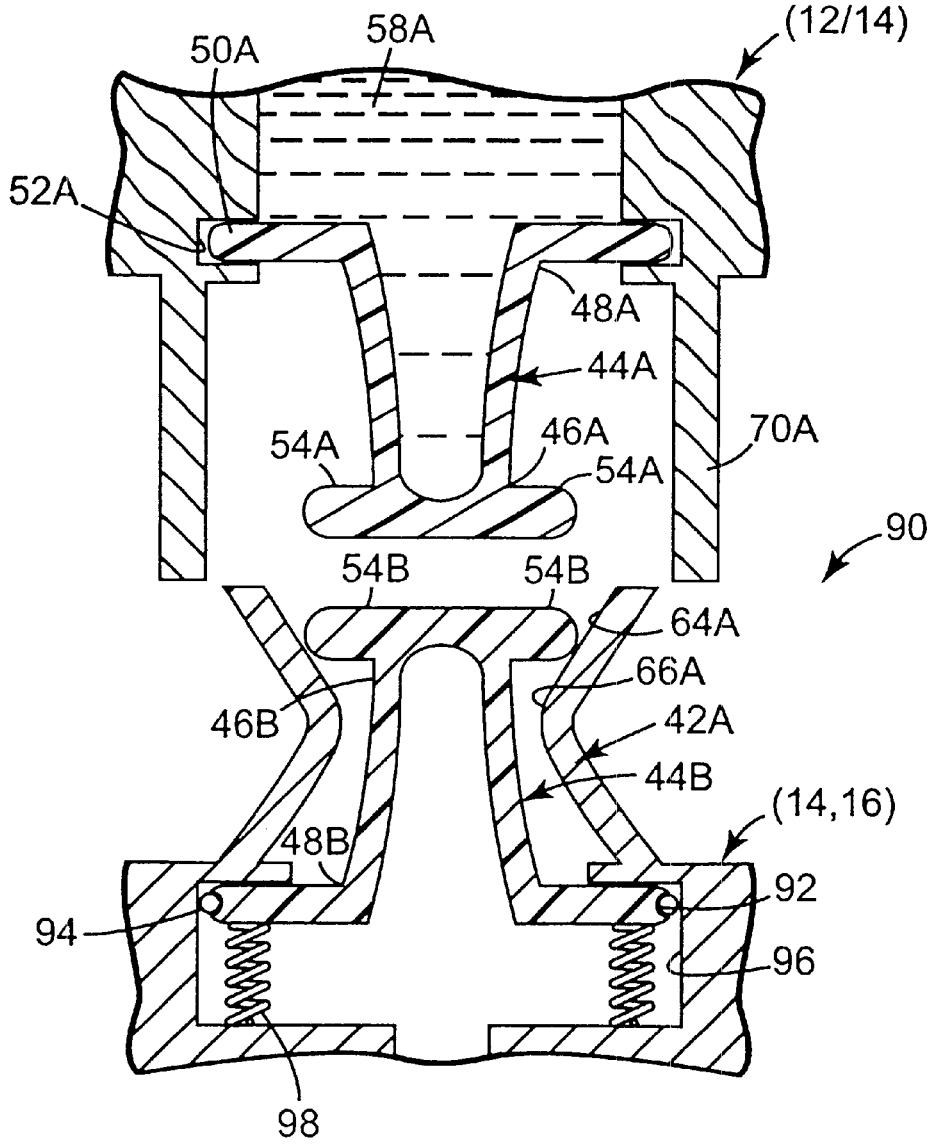
FIG. 7*a* is a side elevational view of an exemplary embodiment pinch seal fluid interconnect showing the elements of the fluid interconnect in a disengaged state in accordance with still one further embodiment of the present invention.
Figure 7B:
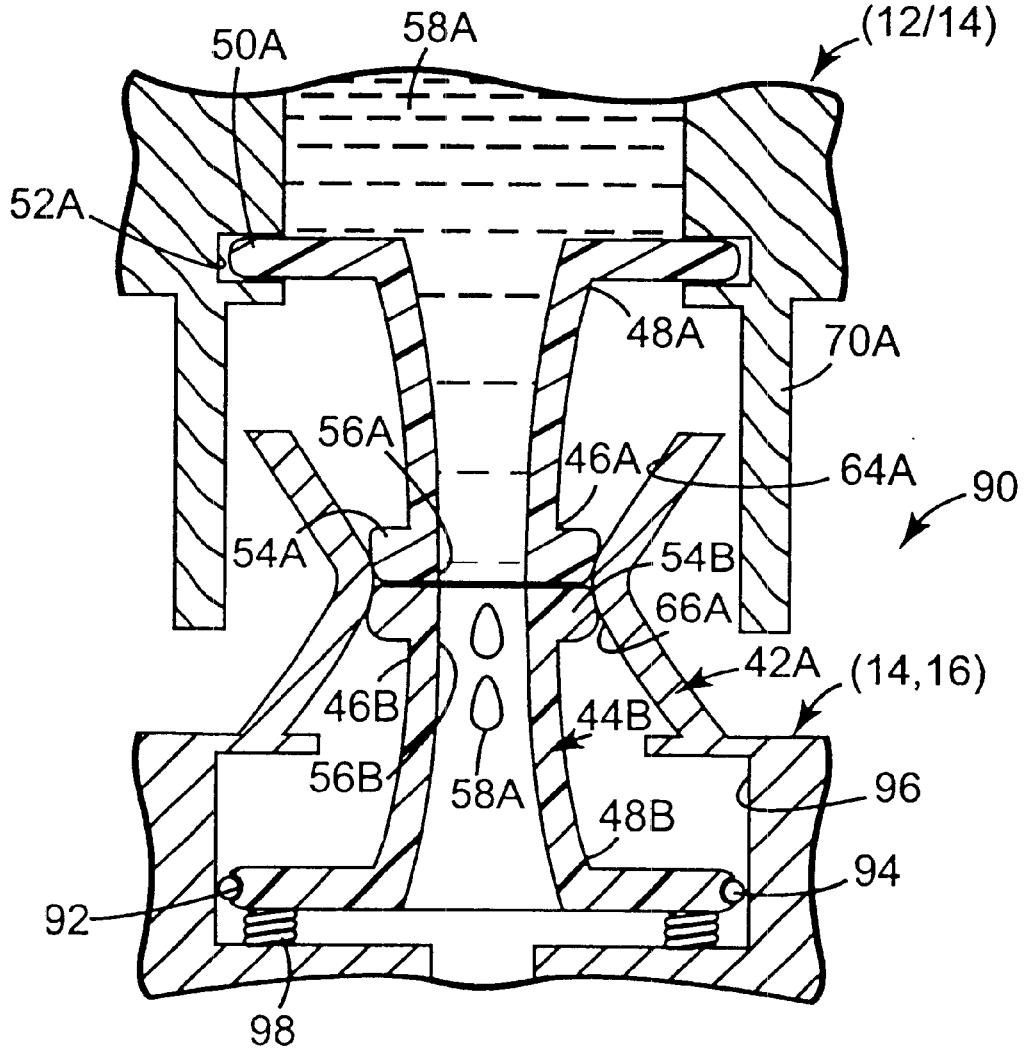
FIG. 7*b* is a side elevational view similar to FIG. 7*a* showing the elements of the fluid interconnect engaged with one another.

FIGS. 7*a* and 7*b* illustrate an alternative embodiment pinch seal fluid interconnect 90. In this embodiment, the pinch valve members 44A and 44B are formed of the same elastomer material and without the rigidifying tubular element 82. In this embodiment, the second end 48B of the pinch valve member 44B includes a circumferential groove 92 for receiving an O-ring 94. The second end 48B of the pinch valve member 44B is received within a bore 96 on the receiving station 14. The O-ring 94 forms a fluid tight seal with the bore 96 and allows the pinch valve member 44B to move relative to the receiving station 14 along the bore 96. A spring member 98 acts between the receiving station 14 and the second end 48B of the pinch valve member 44B to bias the pinch valve member to the position shown in FIG. 7*a* wherein the lips 54B of the pinch valve member 44B are in a closed state.

Upon initial engagement of the container 12 with the receiving station 14, the lead-in region 64A of the tubular member 42A acts to guide the first end 46A of the pinch valve member 44A into the actuating region 66A. Upon full engagement of the container 12 with the receiving station 14, the lips 54A at the first end 46A of the pinch valve member 44A bear against the lips 54B at the first end 46B of the pinch valve member 44B which causes the pinch valve member 44B to move along the bore 96 against the bias of the spring 98 (see FIG. 7*b*). This causes the lips 54A, 54B of both of the pinch valve members 44A, 44B to enter the actuating region 66A of the tubular member 42A which applies the oppositely directed compressive forces 60 to the exterior surfaces 47A, 47B of the lips 54A, 54B of the pinch valve members 44A, 44B in order to deform the lips 54A, 54B and move the slits 56A, 56B from their closed states to the opened states to allow the marking fluid 58 to pass therethrough. The actuating region 66A applies the compressive forces 60 to the lips 54A, 54B because the diameter of the actuating region 66A is less than a maximum linear dimension of the lips 54A, 54B. Removal of the ink container 12 from the receiving station allows the pinch valve member 44B to return to its starting position and the lips 54A, 54B to return to their closed state.

Pinch seal fluid interconnects 80, 90 establish reliable fluid connections between the fluid supply container 12 and the receiving station 14, and between the receiving station 14 and the printhead cartridge 16. However, it is to be understood that the pinch seal fluid interconnect 80, 90 of the present invention can also form a reliable fluid connection between a fluid supply container 12 and a printhead cartridge 16. Moreover, it is to be understood that the pinch valve members 44A, 44B can pass fluid in either direction. In addition the pinch seal fluid interconnect 80, 90 is capable of repeated disconnects and reconnects as the ink supply 12 and printhead 16 are removed and installed. Moreover, the pinch seal fluid interconnect 80, 90 is robust enough to prevent leakage under normal operating and non-operating conditions and under various environmental conditions. In addition, the pinch valve members 44A, 44B prevent drooling of fluid when the ink supply 12 and printhead 16 are separated from the printing system. Moreover, the use of the pair of pinch valve members 44A, 44B minimizes air introduced and ink loss upon disconnects and reconnects of the printer components. The pinch seal fluid interconnect 80, 90 reliably provides these above features throughout the useful life of the fluid delivery system components of the printing system 10 so as to preclude premature replacement of these components and the associated cost. Lastly, the pinch seal fluid interconnect 80, 90 is relatively easy and inexpensive to manufacture, and relatively simple to incorporate into components used in ink delivery systems of thermal inkjet printing systems.

Although the present invention has been described with reference to preferred embodiments, workers skilled in the art will recognize that changes may be made in form and detail without departing from the spirit and scope of the invention.

What is claimed is:

1. A marking fluid valve for a marking fluid delivery system of a media marking device, the marking fluid valve comprising:

a resilient body having first and second opposite ends in fluid communication with one another;

a pair of opposed lips at the first end of the resilient body, the pair of opposed lips defining a normally closed slit extending therebetween, the slit defining an axis, wherein compressing the first end of the resilient body along the axis of the lips deforms the resilient body from a closed position, in which the lips are in contact with one another to close the slit and prevent marking fluid from passing through the slit, to an open position, in which the lips are spread at least partially apart from one another to enable marking fluid to pass through the slit.

2. The marking fluid valve of claim 1 wherein the resilient body defines a marking fluid outlet in which in the open position of the lips, the marking fluid passes through the resilient body from the second end through the open slit at the first end.

3. The marking fluid valve of claim 1 wherein the resilient body defines a marking fluid inlet in which in the open position of the lips, the marking fluid passes into the open slit at the first end of the resilient body and through the resilient body to the second end thereof.

4. The marking fluid valve of claim 1 wherein the resilient body is formed of an elastomer material.

5. The marking fluid valve of claim 1 wherein the second end of the resilient body defines a mounting flange by which the resilient body is mounted to a component of the marking fluid delivery system of the media marking device.

6. The marking fluid valve of claim 1 wherein the second end of the resilient body defines a circumferential groove for receiving an O-ring engageable with a component of the marking fluid delivery system of the media marking device.

7. The marking fluid valve of claim 6 wherein the first end of the cone shaped resilient body is of a first dimension, wherein the second end of the cone shaped resilient body is of a second dimension, and wherein the second dimension is greater than the first dimension.

8. The marking fluid valve of claim 1 wherein between the first and second ends the resilient body is generally cone shaped.

9. The marking fluid valve of claim 1 wherein a compressive force is applied to an exterior of the first end of the resilient body to compress the first end of the resilient body along axes of the lips to deform the resilient body from the closed position to an open position.

10. The marking fluid valve of claim 9 wherein the compressive force is a pair of opposite compressive forces applied to the exterior of the first end of the resilient body in a direction parallel to the axes of the lips to compress the first end of the resilient body along axes of the lips to deform the resilient body from the closed position to an open position.

11. A fluid valve interconnect for a fluid delivery system of a printing device, the fluid valve interconnect comprising:

a resilient body having first and second opposite ends in fluid communication with one another, an exterior surface and an interior surface;

a pair of opposed lips at the first end of the resilient body, the pair of opposed lips defining a normally closed slit extending therebetween, wherein application of a force to the exterior of the resilient body moves the lips of the resilient body from a closed state in which the lips are in contact with one another to close the slit and prevent fluid from passing through the slit, to an open state in which the lips are separated at least partially apart from one another to enable fluid to pass through the slit.

12. The fluid valve of claim 11 wherein the force applied to the exterior of the resilient body is a compressive force.

13. The fluid valve of claim 12 wherein the compressive force is applied to the lips at the first end of the resilient body.

14. The fluid valve of claim 13 wherein the compressive force is applied to the lips in a directional generally parallel to a longitudinal extent of the slit.

15. The fluid valve of claim 14 wherein the compressive force is defined by a pair of opposed compressive forces applied to the lips at opposite ends of the of the slit.

16. A fluid delivery system for a printing system, the fluid delivery system comprising:

a first component including:

a substantially rigid tubular member;

a second component engageable with the first component, the second component including:

a resilient body having a first end with a pair of opposed lips defining a normally closed slit extending therebetween, wherein engagement of the second component with the first component causes the resilient body to be received by the rigid tubular member, the tubular member applying a force to an exterior of the resilient body which deforms the lips of the resilient body from a closed state, in which the lips are in contact with one another to close the slit and prevent fluid from passing through the slit, to an open state, in which the lips are separated at least partially apart from one another to enable fluid to pass through the slit.

17. The fluid delivery system of claim 16 wherein the resilient body further includes an opposite second end in fluid communication with the first end, the second end defining a flange portion adapted for mounting the resilient body to the second component.

18. The fluid delivery system of claim 16 wherein interior wall portions of the tubular member define a lead-in region and an actuating region, the lead-in region acting to guide the resilient body into the actuating region which acts to apply the force to the exterior of the resilient body which deforms the lips of the resilient body from the closed state to the open state.

19. The fluid delivery system of claim 18 wherein the interior wall portion defining the lead-in region has a first pitch, wherein the interior wall portion defining the actuating region has a second pitch, and wherein the second pitch is greater than the first pitch.

20. The fluid delivery system of claim 18 wherein the first component further includes:

a resilient body positioned within the tubular member, the resilient body of the first component having a first end with a pair of opposed lips defining a normally closed slit extending therebetween, and an opposite second end in fluid communication with the first end, wherein engagement of the second component with the first component causes the resilient body of the second component to be received by the rigid tubular member, the tubular member applying a force to exteriors of the resilient bodies of the first and second components which deforms the lips of the resilient bodies from a closed state in which the lips are in contact with one another to close the slit and prevent fluid from passing through the slit, to an open state in which the lips are separated at least partially apart from one another to enable fluid to pass through the slits.

21. The fluid delivery system of claim 20 wherein in the closed state of the lips of the resilient body of the first component, the lips are positioned within the lead-in region of the tubular member.

22. The fluid delivery system of claim 21 wherein engagement of the second component with the first component causes the lips of the resilient bodies of the first and second components to be received by the actuating portion of the rigid tubular member which acts to apply the force to the exteriors of the resilient bodies which deforms the lips of the resilient bodies from the closed state to the open state.

23. The fluid delivery system of claim 22 wherein when the lips of the resilient body of the first component are received by the actuating portion of the rigid tubular member, the resilient body is deformed between its first and second ends.

24. The fluid delivery system of claim 22 wherein the resilient body of the first component is movably mounted to the first component so as to move from a first position wherein the lips are in the closed state, and a second position in which the lips are in the open state, and wherein engagement of the second component with the first component moves the resilient body of the first component relative to the first component from the first position to the second position.

25. The fluid delivery system of claim 24 wherein the resilient body is spring biased to be normally in the first position.

26. The fluid delivery system of claim 16 wherein the first end of the resilient body has a perimeter and a maximum dimension between opposed points on the perimeter, and wherein the tubular member defines an interior wall portion having a diameter that is less than the maximum dimension, such that insertion of the resilient body into this interior wall portion deforms the lips at the first end of the resilient body from the closed state to the open state.

27. The fluid delivery system of claim 16 wherein the second component is a fluid supply container.

28. The fluid delivery system of claim 27 wherein the first component is a printing system manifold adapted to removably receive the fluid supply container.

29. The fluid delivery system of claim 27 wherein the first component is a printhead adapted to removably receive the fluid supply container.

30. The fluid delivery system of claim 16 wherein the second component is a printing system manifold.

31. The fluid delivery system of claim 30 wherein the first component is a fluid supply container adapted to be removably received by the printing system manifold.

32. The fluid delivery system of claim 30 wherein the first component is a printhead adapted to be removably received by the printing system manifold.

33. The fluid delivery system of claim 16 wherein the first component is a fluid supply container.

34. The fluid delivery system of claim 16 wherein the second component is a printhead, and the first component is a fluid supply container adapted to be removably received by the printhead.

35. The fluid delivery system of claim 16 wherein the second component is a printhead, and the first component is a printing system manifold adapted to removably receive the printhead.

* * * * *